US010114312B2

(12) United States Patent
Kitagawa et al.

(10) Patent No.: US 10,114,312 B2
(45) Date of Patent: Oct. 30, 2018

(54) IMAGE FORMING APPARATUS AND TONER CASE

(71) Applicant: KYOCERA Document Solutions Inc., Osaka (JP)

(72) Inventors: Hiroaki Kitagawa, Osaka (JP); Teruyuki Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/791,473

(22) Filed: Oct. 24, 2017

(65) Prior Publication Data

US 2018/0120734 A1 May 3, 2018

(30) Foreign Application Priority Data

Nov. 1, 2016 (JP) ..... 2016-214625

(51) Int. Cl.
*G03G 15/08* (2006.01)

(52) U.S. Cl.
CPC ..... *G03G 15/0886* (2013.01); *G03G 15/0872* (2013.01); *G03G 15/0875* (2013.01)

(58) Field of Classification Search
CPC ..... G03G 15/0886; G03G 15/0872
See application file for complete search history.

(56) References Cited

U.S. PATENT DOCUMENTS

2007/0237551 A1* 10/2007 Kawai ..... G03G 15/0898 399/258
2016/0004182 A1 1/2016 Yago et al.
2017/0285530 A1* 10/2017 Nishiyama ..... G03G 15/0889

FOREIGN PATENT DOCUMENTS

JP 2016-014813 A 1/2016

* cited by examiner

*Primary Examiner* — Rodney A Bonnette
(74) *Attorney, Agent, or Firm* — Studebaker & Brackett PC

(57) ABSTRACT

An image forming apparatus includes a toner case and an attachment part. The toner case includes a discharge shutter movable between a first closing position where a discharge port is closed and a first opening position where the discharge port is opened. The attachment part includes a replenishment shutter movable between a second closing position where a replenishment port is closed and a second opening position where the replenishment port is opened. As the discharge shutter moves from the first closing position to the first opening position, the discharge shutter presses the replenishment shutter to move the replenishment shutter from the second closing position to the second opening position. As the discharge shutter moves from the first opening position to the first closing position, the discharge shutter presses the replenishment shutter to move the replenishment shutter from the second opening position to the second closing position.

9 Claims, 11 Drawing Sheets

IMAGE FORMING APPARATUS AND TONER CASE

INCORPORATION BY REFERENCE

This application is based on and claims the benefit of priority from Japanese Patent application No. 2016-214625 filed on Nov. 1, 2016, which is incorporated by reference in its entirety.

BACKGROUND

The present disclosure relates to an image forming apparatus and a toner case detachably attached to an attachment part of the image forming apparatus.

An image forming apparatus, such as a printer, a copying machine, a facsimile and a multifunctional peripheral, includes a toner case which replenishes a developing device with a toner (a developer). For instance, the image forming apparatus may include the toner case and an attachment part to which the toner case is detachably attached. The above described attachment part has a replenishment port through which the toner discharged from the toner case is introduced. The replenishment port is opened and closed by a replenishment shutter.

SUMMARY

In accordance with an aspect of the present disclosure, an image forming apparatus includes a toner case and an attachment part to which the toner case is detachably attached. The toner case includes a case main body and a discharge shutter. The case main body has a discharge port through which a toner is discharged. The discharge shutter is movable between a first closing position where the discharge shutter closes the discharge port and a first opening position where the discharge shutter opens the discharge port. The attachment part includes a housing and a replenishment shutter. The housing has a replenishment port through which the toner discharged through the discharge port is introduced. The replenishment shutter is movable between a second closing position where the replenishment shutter closes the replenishment port and a second opening position where the replenishment shutter opens the replenishment port. As the discharge shutter moves from the first closing position to the first opening position, the discharge shutter presses the replenishment shutter to move the replenishment shutter from the second closing position to the second opening position. As the discharge shutter moves from the first opening position to the first closing position, the discharge shutter presses the replenishment shutter to move the replenishment shutter from the second opening position to the second closing position.

In accordance with an aspect of the present disclosure, a toner case is detachably attached to an attachment part of an image forming apparatus. The toner case includes a case main body and a discharge shutter. The case main body has a discharge port through which a toner is discharged. The discharge shutter is movable between a first closing position where the discharge shutter closes the discharge port and a first opening position where the discharge shutter opens the discharge port. The attachment part includes a housing and a replenishment shutter. The housing has a replenishment port through which the toner discharged through the discharge port is introduced. The replenishment shutter is movable between a second closing position where the replenishment shutter closes the replenishment port and a second opening position where the replenishment shutter opens the replenishment port. As the discharge shutter moves from the first closing position to the first opening position, the discharge shutter presses the replenishment shutter to move the replenishment shutter from the second closing position to the second opening position. As the discharge shutter moves from the first opening position to the first closing position, the discharge shutter presses the replenishment shutter to move the replenishment shutter from the second opening position to the second closing position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a multifunctional peripheral 1 (an example of an image forming apparatus) according to an embodiment of the present disclosure will be described. Arrows Fr, Rr, L, R, U and Lo shown in each figure respectively indicate a front side, a rear side, a left side, a right side, an upper side and a lower side of the multifunctional peripheral 1.

Firstly, an entire structure of the multifunctional peripheral 1 will be described.

Figure 1:
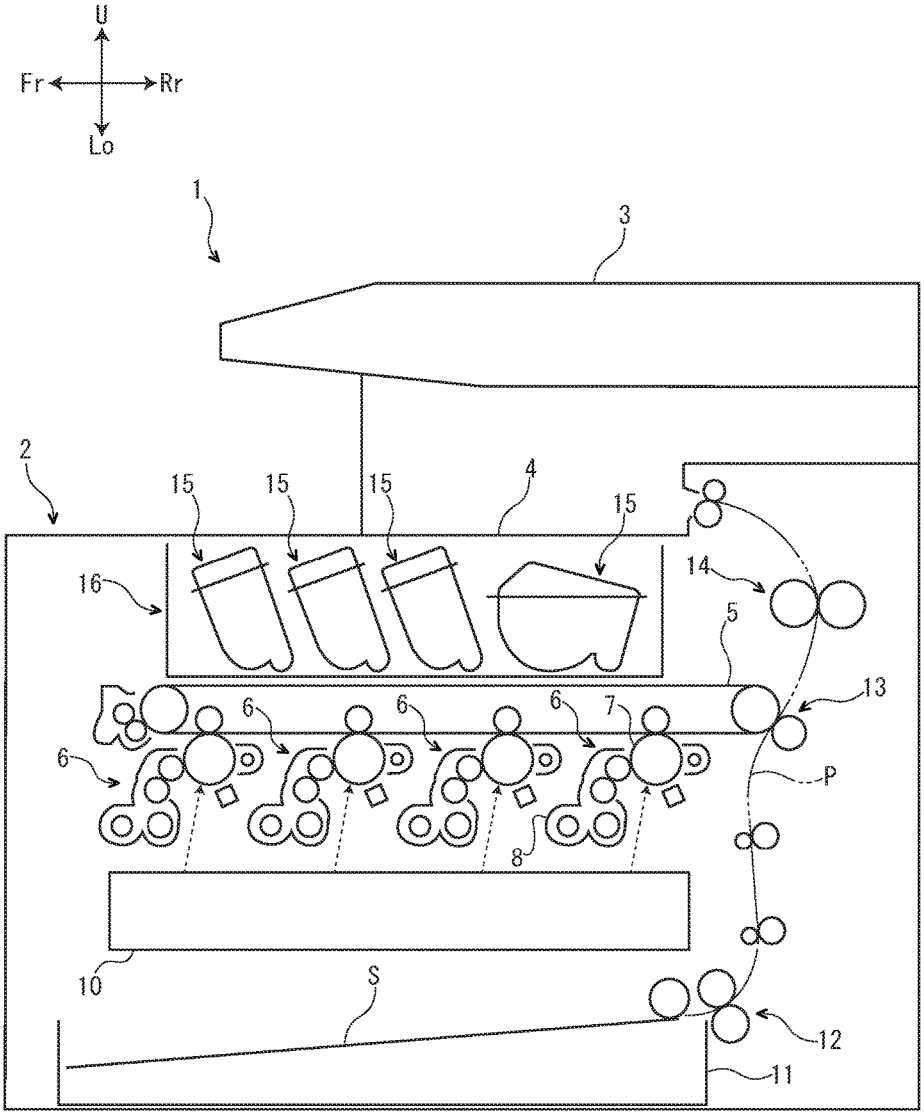
FIG. 1 is a schematic view showing a multifunctional peripheral according to an embodiment of the present disclosure.

As shown in FIG. 1, the multifunctional peripheral 1 includes a box-shaped multifunctional peripheral main body 2 (an example of an apparatus main body). On an upper end of the multifunctional peripheral main body 2, an image reading device 3 configured to read a document image is provided. In an upper portion of the multifunctional peripheral main body 2, an ejected sheet tray 4 is provided. In an approximate center portion of the multifunctional peripheral main body 2, an intermediate transferring belt 5 and four image forming parts 6 are stored. Each image forming part 6 corresponds to a toner (a developer) of black, cyan, magenta and yellow, in this order from the rear side. Each image forming part 6 includes a photosensitive drum 7 (an example of an image carrier) and a developing device 8. In a lower portion of the multifunctional peripheral main body 2, an exposing device 10 is stored. In a lower end portion of the multifunctional peripheral main body 2, a sheet feeding cassette 11 which stores a sheet S (an example of a recording medium) is stored.

In a rear side portion of the multifunctional peripheral main body 2, a conveying path P for the sheet S is provided. At an upstream end of the conveying path P, a sheet feeding part 12 is provided. At a middle portion of the conveying path P, a secondary transferring part 13 is provided. At a downstream portion of the conveying path P, a fixing device 14 is provided.

In the upper portion of the multifunctional peripheral main body 2, four toner containers 15 (an example of toner cases) are provided under the ejected sheet tray 4. Each toner container 15 corresponds to the toner of black, cyan, magenta and yellow, in this order from the rear side. Each toner container 15 is detachably attached to an attachment part 16 provided at the upper portion of the multifunctional peripheral main body 2.

Next, an operation of the multifunctional peripheral 1 will be described.

Firstly, light (refer to a dotted line arrow in FIG. 1) emitted from the exposing device 10 exposes the photosensitive drum 7 of each image forming part 6 to form an electrostatic latent image on the photosensitive drum 7. The electrostatic latent image is developed by the developing device 8 of each image forming part 6. Thereby, a toner image is carried on the photosensitive drum 7. The toner image is primarily transferred on the intermediate transferring belt 5 from the photosensitive drum 7 of each image forming part 6. Thereby, a full color toner image is formed on the intermediate transferring belt 5.

The sheet S fed from the sheet feeding cassette 11 by the sheet feeding part 12 is conveyed to the downstream side along the conveying path P and enters the secondary transferring part 13. At the secondary transferring part 13, the full color toner image formed on the intermediate transferring belt 5 is secondarily transferred on the sheet S. The sheet S on which the toner image is transferred is conveyed to the downstream side along the conveying path P and enters the fixing device 14. The fixing device 14 fixes the toner image on the sheet S. The sheet S on which the toner image is fixed is ejected on the ejected sheet tray 4.

Next, each toner container 15 will be described in detail.

Figure 2:
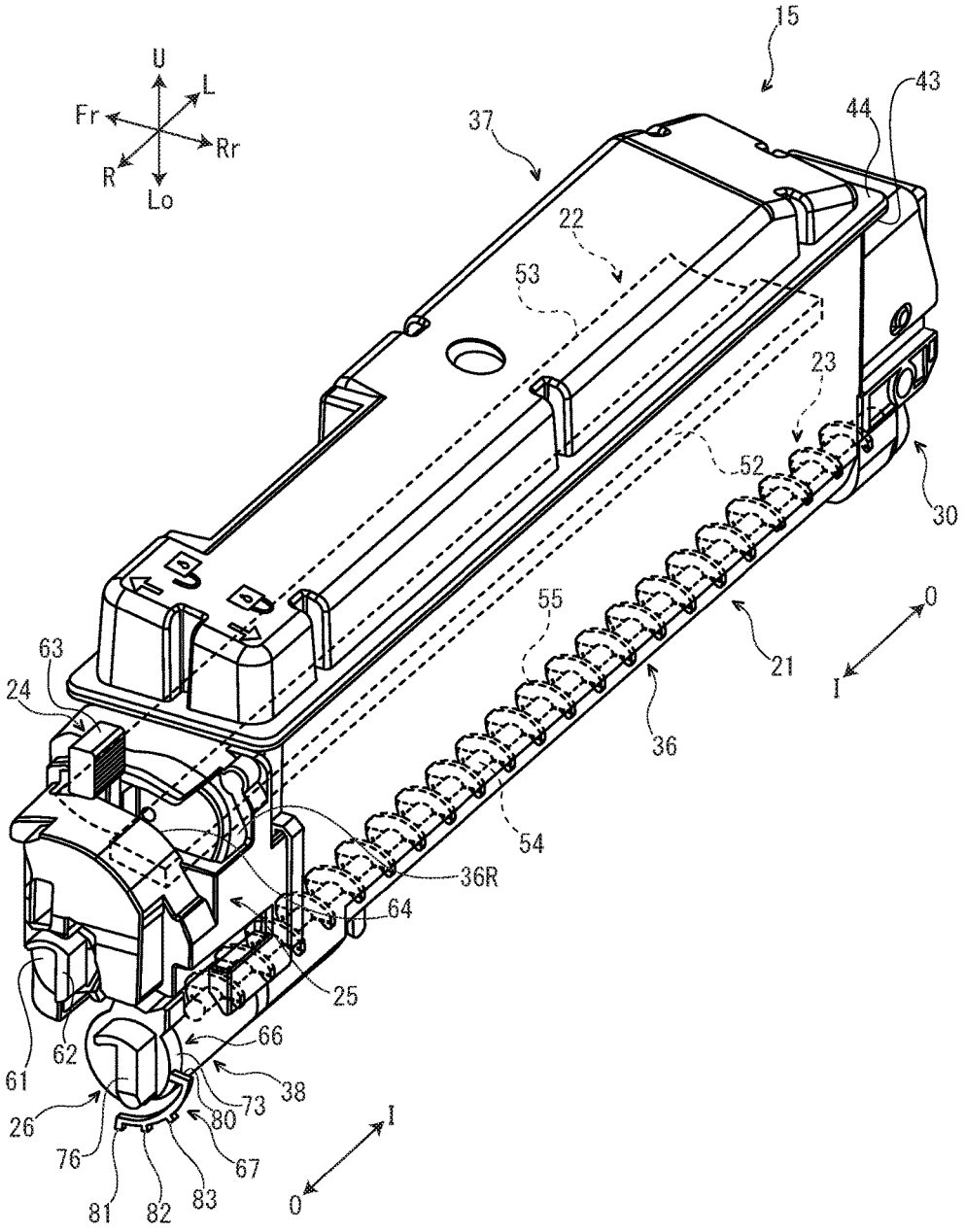
FIG. 2 is a perspective view showing a toner container according to the embodiment of the present disclosure.

An arrow O shown in each figure after FIG. 2 indicates an outside in the left-and-right direction of each toner container 15, and an arrow I shown in each figure after FIG. 2 indicates an inside in the left-and-right direction of each toner container 15.

Figure 3:
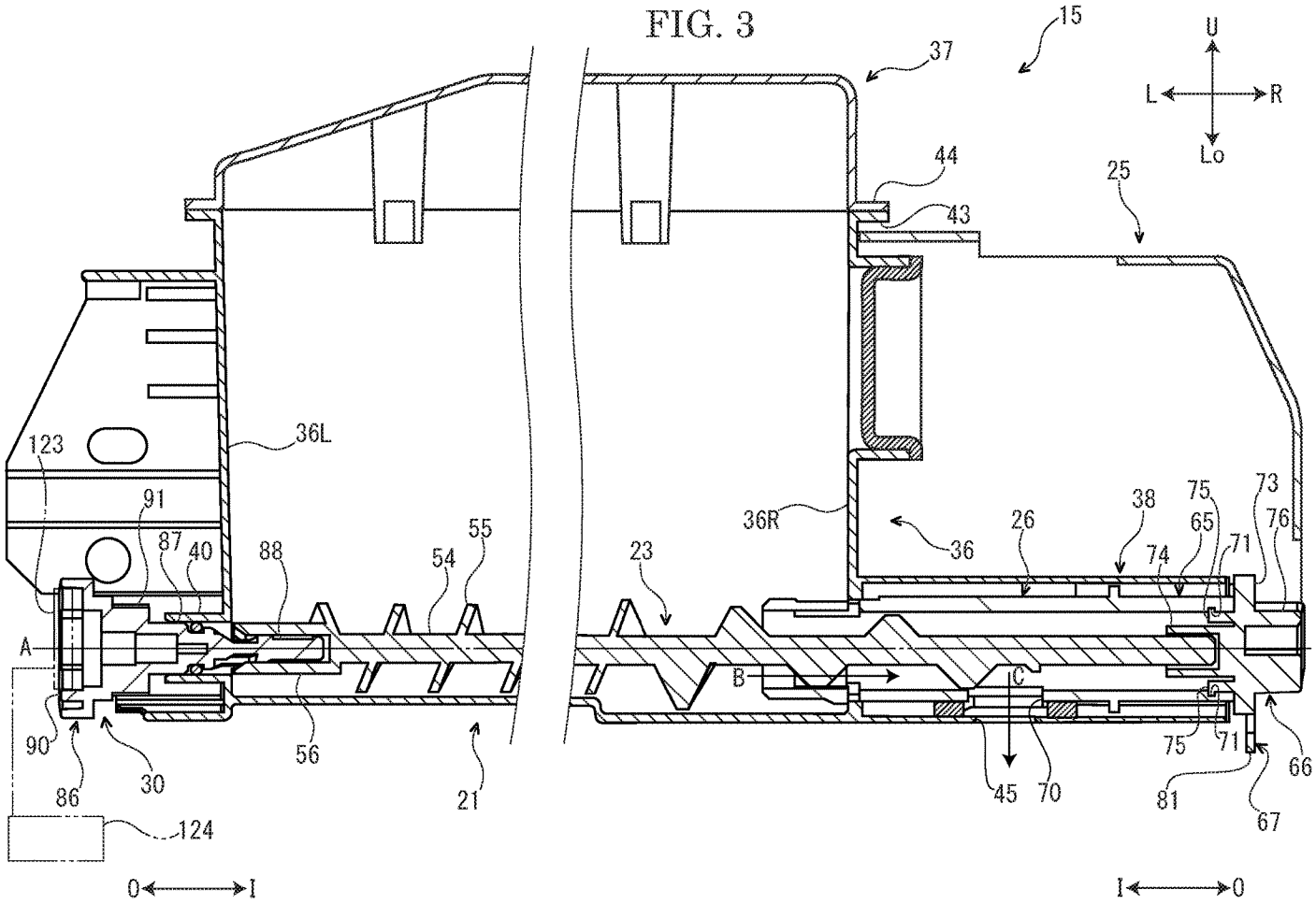
FIG. 3 is a sectional view showing the toner container according to the embodiment of the present disclosure.

With reference to FIG. 2 and FIG. 3, each toner container 15 includes a case main body 21, an agitator 22 stored in a center portion of the case main body 21, a conveyer 23 (an example of a rotator) stored in a rear lower portion of the case main body 21, a lever 24 (an example of a manipulation member) arranged at the right end side of the case main body 21, a cover 25 provided so as to cover the lever 24, a discharge shutter 26 arranged at the lower side of the cover 25 and a transmitter 30 arranged at the left end side of the case main body 21.

The case main body 21 of each toner container 15 stores the toner (the developer). The case main body 21 includes a storage 36, a lid 37 provided at the upper side of the storage 36 and a duct 38 provided at the right lower side of the storage 36.

The storage 36 of the case main body 21 is formed in a box-like shape whose upper side is opened. The storage 36 is elongated in the left-and-right direction. On a lower portion of a left side wall 36L of the storage 36, an outer cylindrical part 40 is protruded toward the left side (the outside in the left-and-right direction). The outer cylindrical part 40 is formed in a cylindrical shape elongated along the left-and-right direction. Around an upper end of an outer circumference of the storage 36, a lower side flange portion 43 is provided.

The lid 37 of the case main body 21 is formed in a box-like shape whose lower side is opened. Around a lower end of an outer circumference of the lid 37, an upper side flange portion 44 is provided. The upper side flange portion 44 is fixed to the lower side flange portion 43 of the storage 36. Thereby, the lid 37 is integrated with the storage 36. An inner space of the lid 37 is communicated with an inner space of the storage 36.

The duct 38 of the case main body 21 is formed in a cylindrical shape extending along the left-and-right direction. The duct 38 is formed integrally with the storage 36 of the case main body 21, and extends from a lower end portion of a right side wall 36R of the storage 36 toward the right side (the outside in the left-and-right direction). An inner space of the duct 38 is communicated with the inner space of the storage 36. On a lower face of the duct 38, a discharge port 45 through which the toner is discharged is provided.

With reference to FIG. 2, the agitator 22 of each toner container 15 is stored in the storage 36 of the case main body 21. The agitator 22 is rotatable. The agitator 22 includes an agitating shaft 52 and an agitating blade 53 mounted to the agitating shaft 52. The agitating shaft 52 extends along the left-and-right direction. The agitating blade 53 is made of resin film, for example, and formed in a sheet-like shape.

With reference to FIG. 3, a left side portion and a center portion in the left-and-right direction of the conveyer 23 of each toner container 15 are stored in the storage 36 of the case main body 21. A right side portion of the conveyer 23 is stored in the duct 38 of the case main body 21. The conveyer 23 is rotatable around a rotation axis A extending along the left-and-right direction. That is, the left-and-right direction is a rotation axis direction of the conveyer 23.

The conveyer 23 includes a conveying shaft 54 extending along the left-and-right direction and a spiral conveying fin 55 protruding on an outer circumference of the conveying shaft 54. On a left end portion of the conveying shaft 54, a cylindrical shaped coupling cylindrical part 56 is provided.

With reference to FIG. 2, the lever 24 of each toner container 15 is arranged at the right side (the outside in the left-and-right direction) of the case main body 21. The lever 24 includes a fulcrum part 61, a drive protruding part 62 protruding on a right face (a face at the outside in the left-and-right direction) of the fulcrum part 61 and a manipulated part 63 (only its upper end portion is shown in FIG. 2) extending upward from the fulcrum part 61. The lever 24 is supported by the right side wall 36R of the storage 36 of the case main body 21 so as to be rotatable around the fulcrum part 61.

The cover 25 of each toner container 15 is fixed to the storage 36 of the case main body 21, and covers the right side wall 36R of the storage 36 from the right side (the outside in the left-and-right direction). In an upper portion of the cover 25, a window 64 is provided. Through the window 64, the upper end portion of the manipulated part 63 of the lever 24 is exposed to an outside of each toner container 15.

The discharge shutter 26 of each toner container 15 is arranged at the right end side of the conveyer 23. With reference to FIG. 2 and FIG. 3, the discharge shutter 26 includes a main body part 65, a closing part 66 attached to a right end portion (an end portion at the outside in the left-and-right direction) of the main body part 65 and an arm part 67 arranged along an outer circumferential face of the closing part 66.

The main body part 65 of the discharge shutter 26 is formed in a cylindrical shape extending along the left-and-right direction. In the main body part 65, the right side portion of the conveyer 23 is stored. The main body part 65 is rotatably attached to an inner circumference of the duct 38. Thereby, the discharge shutter 26 is rotatable between a first closing position (refer to FIG. 4) where the main body part 65 closes the discharge port 45 of the duct 38 and a first opening position (refer to FIG. 5) where the main body part 65 opens the discharge port 45 of the duct 38. Hereinafter, a rotating direction of the discharge shutter 26 from the first closing position to the first opening position is called as a rotating direction RD (refer to FIG. 6).

Figure 4:
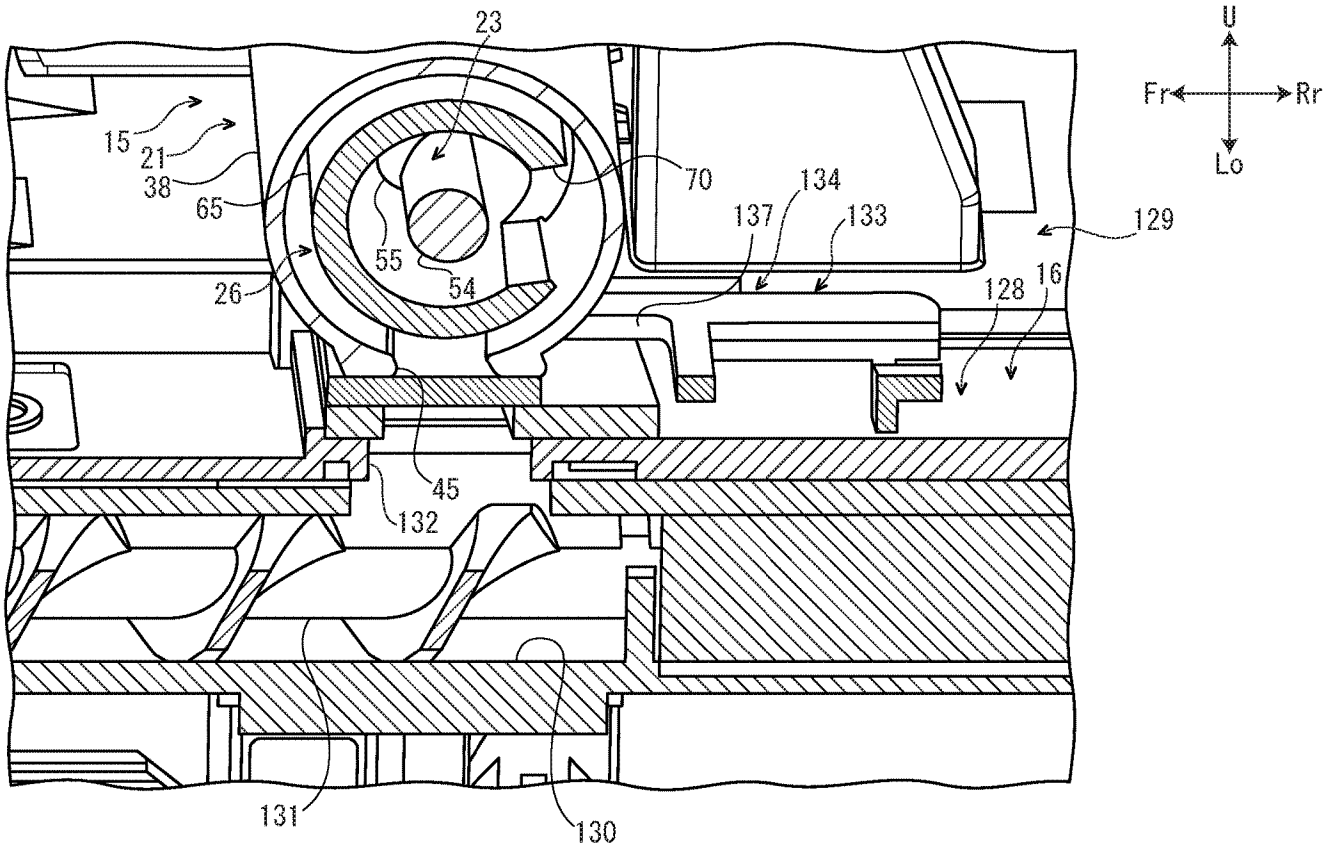
FIG. 4 is a sectional view showing a state where a discharge shutter is moved to a first closing position and a replenishment shutter is moved to a second closing position, in the multifunctional peripheral according to the embodiment of the present disclosure.
Figure 5:
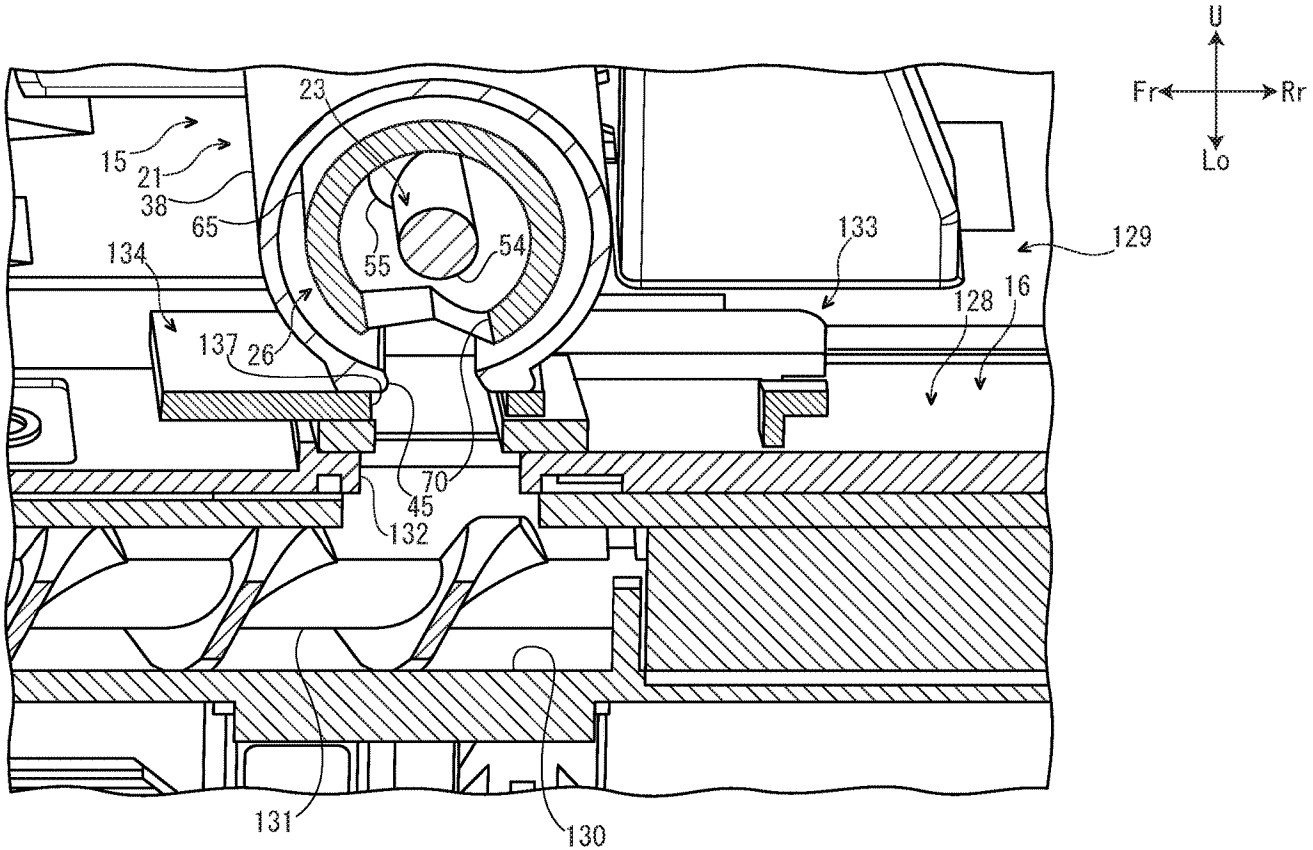
FIG. 5 is a sectional view showing a state where the discharge shutter is moved to a first opening position and the replenishment shutter is moved to a second opening position, in the multifunctional peripheral according to the embodiment of the present disclosure.

With reference to FIG. 3 to FIG. 5, the main body part 65 of the discharge shutter 26 has a communication port 70. The communication port 70 is not communicated with the discharge port 45 of the duct 38 in a state where the discharge shutter 26 is rotated to the first closing position, and is communicated with the discharge port 45 of the duct 38 in a state where the discharge shutter 26 is rotated to the first opening position. On an inner circumferential face of the main body part 65, a pair of fitting grooves 71 (refer to FIG. 3) is formed.

With reference to FIG. 3, the closing part 66 of the discharge shutter 26 includes a flat plate part 73, a supporting cylindrical part 74 and a pair of fitting protruding parts 75 which protrude on a left face (a face at the inside in the left-and-right direction) of the flat plate part 73, and a driven protruding part 76 protruding on a right face (a face at the outside in the left-and-right direction) of the flat plate part 73. The flat plate part 73 is formed in a flat plate-like shape along a face perpendicular to the left-and-right direction. The flat plate part 73 closes the right end portion (the end portion at the outside in the left-and-right direction) of the main body part 65 of the discharge shutter 26. Into the supporting cylindrical part 74, a right end portion of the conveying shaft 54 of the conveyer 23 is rotatably inserted. The pair of fitting protruding parts 75 is fitted into the pair of fitting grooves 71 provided on the inner circumferential face of the main body part 65 of the discharge shutter 26. Thereby, the closing part 66 is fixed to the main body part 65.

Figure 6:
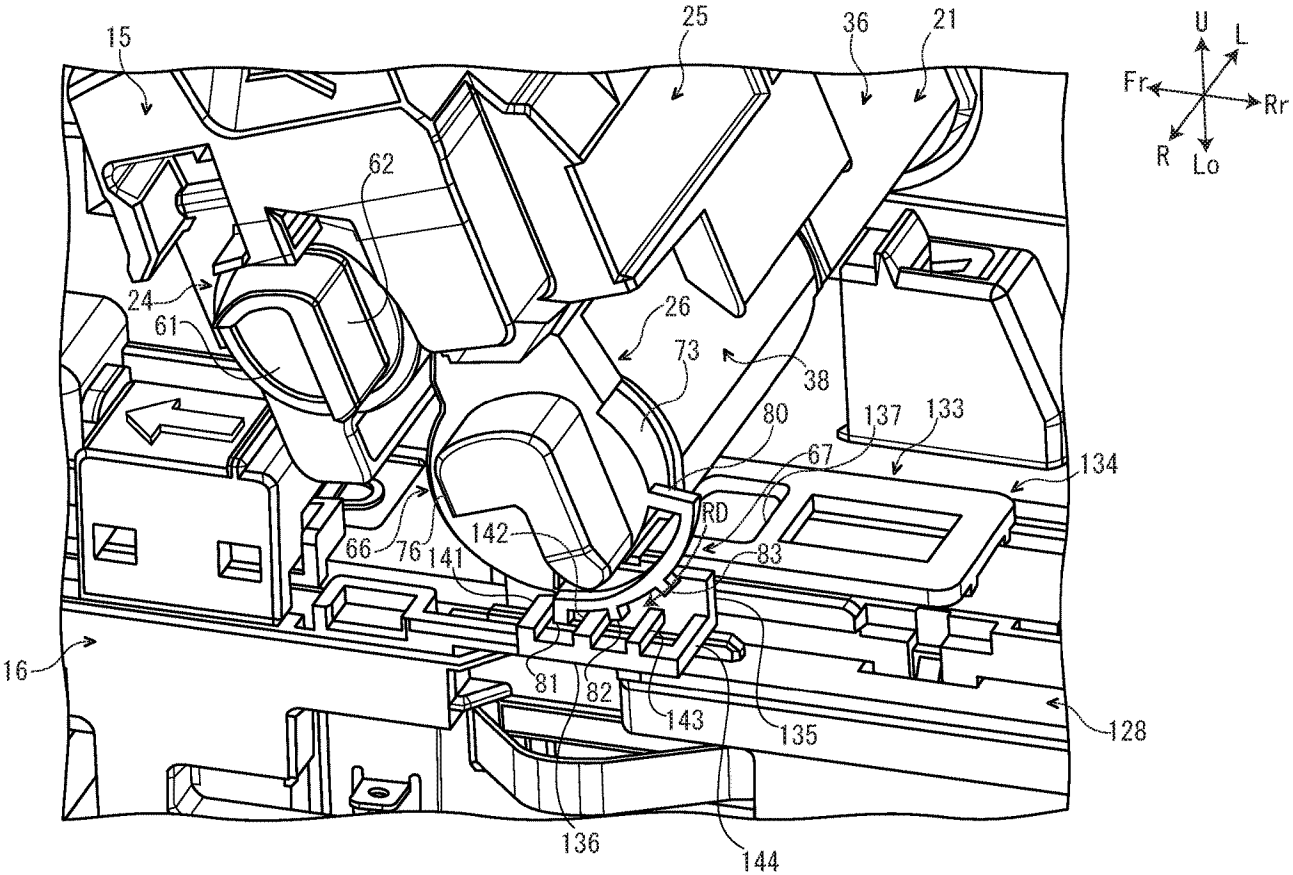
FIG. 6 is a perspective view showing the discharge shutter, the replenishment shutter and their vicinities, in the multifunctional peripheral according to the embodiment of the present disclosure.

With reference to FIG. 6, the arm part 67 of the discharge shutter 26 is curved in an arc-shape along the rotating direction RD. One end in a longitudinal direction of the arm part 67 (an upstream side end in the rotating direction RD) is connected to an outer circumferential face of the flat plate part 73 of the closing part 66 via a connecting piece 80. Another end in the longitudinal direction of the arm part 67 (a downstream side end in the rotating direction RD) is free, and faces the outer circumferential face of the flat plate part 73 of the closing part 66 with a gap. Thereby, the arm part 67 is elastically deformable around the one end in the longitudinal direction.

On an outer circumferential face of the arm part 67 of the discharge shutter 26, a first pressing part 81, a second pressing part 82 provided at an upstream side of the first pressing part 81 in the rotating direction RD and a third pressing part 83 provided at an upstream side of the second pressing part 82 in the rotating direction RD are protruded. The first to third pressing parts 81 to 83 are arranged along the rotating direction RD at equal intervals.

With reference to FIG. 3, the transmitter 30 of each toner container 15 is arranged at the left end side of the conveyer 23. The transmitter 30 penetrates through the outer cylindrical part 40 provided on the left side wall 36L of the storage 36 of the case main body 21. The transmitter 30 is rotatable around the rotation axis A.

The transmitter 30 includes an annular exposed piece 86, an inserted piece 87 protruding to the right side (the inside in the left-and-right direction) from the exposed piece 86 and a coupled piece 88 protruding to the right side (the inside in the left-and-right direction) from the inserted piece 87. The exposed piece 86 is exposed to the outside of the case main body 21. On a left face (a face at the outside in the left-and-right direction) of the exposed piece 86, a transmitting coupling 90 is provided. Around an outer circumferential face of the exposed piece 86, a transmitting gear 91 is formed. The transmitting gear 91 is connected to the agitating shaft 52 of the agitator 22 (refer to FIG. 2) via a connecting gear (not shown). With reference to FIG. 3, the inserted piece 87 is inserted into the outer cylindrical part 40 provided on the left side wall 36L of the storage 36 of the case main body 21. The coupled piece 88 is inserted into the coupling cylindrical part 56 of the conveying shaft 54 of the conveyer 23, and coupled to the coupling cylindrical part 56. Thereby, the transmitter 30 is fixed to the left end portion of the conveying shaft 54.

Next, the attachment part 16 will be described in detail.

Figure 7:
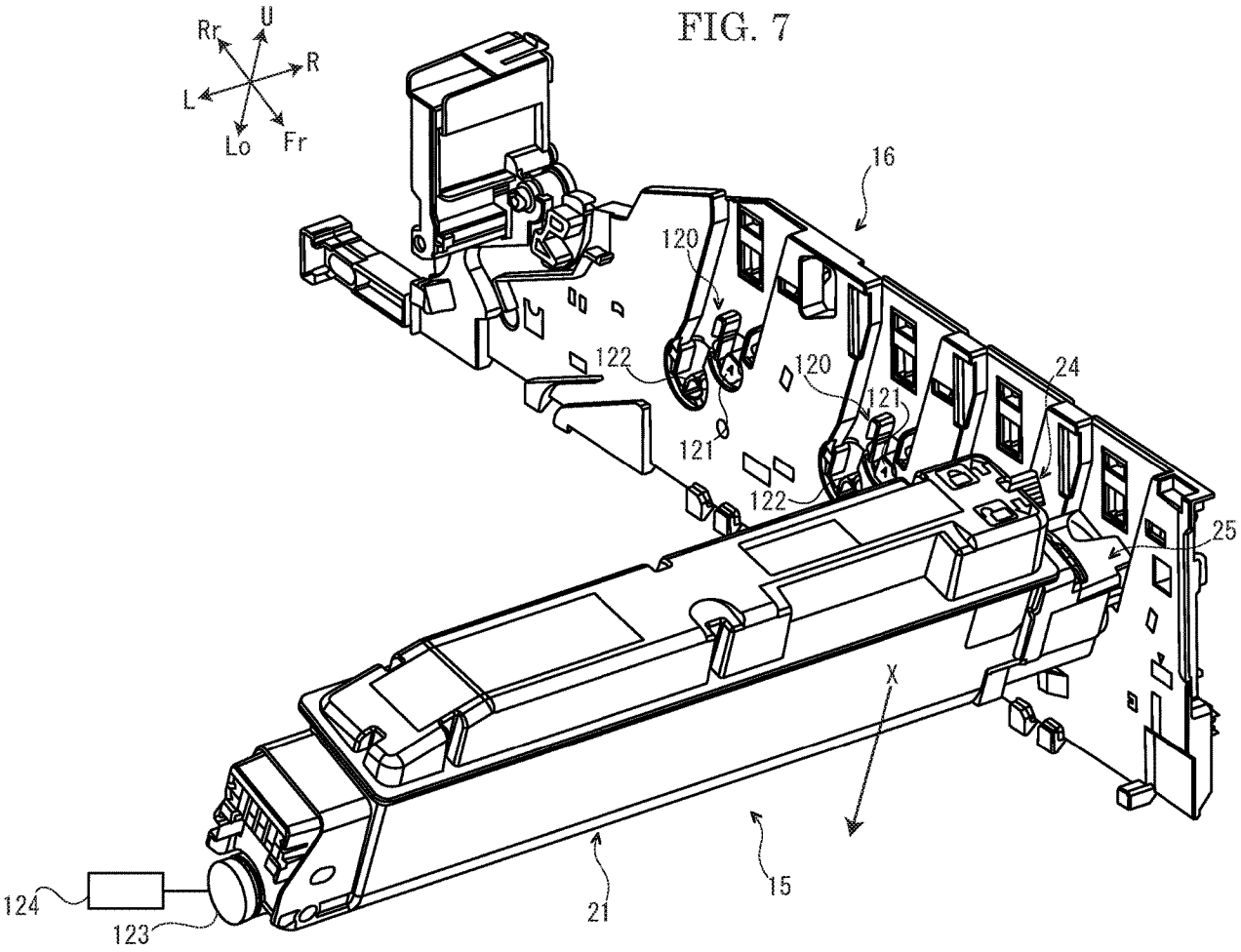
FIG. 7 is a perspective view showing the toner container and an attachment part, in the multifunctional peripheral according to the embodiment of the present disclosure.

With reference to FIG. 7, to the attachment part 16, each toner container 15 (one of them is only shown in FIG. 7) is detachably attached along an attachment direction X from the upper side to the lower side. In the attachment part 16, four connecting mechanisms 120 (two of them are only shown in FIG. 7) are provided at the right sides of attachment positions of the toner containers 15. Each connecting mechanism 120 includes a first connecting member 121 and a second connecting member 122 connected to the first connecting member 121 via a gear part (not shown). The first connecting member 121 is engaged with the drive protruding part 62 of the lever 24 of each toner container 15 in a state where each toner container 15 is attached to the attachment part 16. The second connecting member 122 is engaged with the driven protruding part 76 of the discharge shutter 26 of each toner container 15 in the state where each toner container 15 is attached to the attachment part 16. As described above, each connecting mechanism 120 connects the lever 24 to the discharge shutter 26 in the state where each toner container 15 is attached to the attachment part 16.

In the attachment part 16, four driving couplings 123 (one of them is only shown in FIG. 7) are provided at the left sides of the attachment positions of the toner containers 15. Each driving coupling 123 is connected to a driving source 124 constituted by a motor and the others, and configured to be driven by driving force from the driving source 124 to be rotated.

With reference to FIG. 4 and FIG. 5, the attachment part 16 includes a casing 128. The casing 128 forms a part of an intermediate transferring unit 129 including the intermediate transferring belt 5 (refer to FIG. 1), for example. Inside the casing 128, four replenishment ducts 130 (one of them is only shown in FIG. 4 and FIG. 5) are provided along the front-and-rear direction. The attachment part 16 includes four replenishment screws 131 (one of them is only shown in FIG. 4 and FIG. 5) which are stored in the replenishment ducts 130. Each replenishment screw 131 extends along the front-and-rear direction. On an upper face of the casing 128, four replenishment ports 132 (one of them is only shown in FIG. 4 and FIG. 5) communicated with the replenishment ducts 130 are provided.

Figure 8:
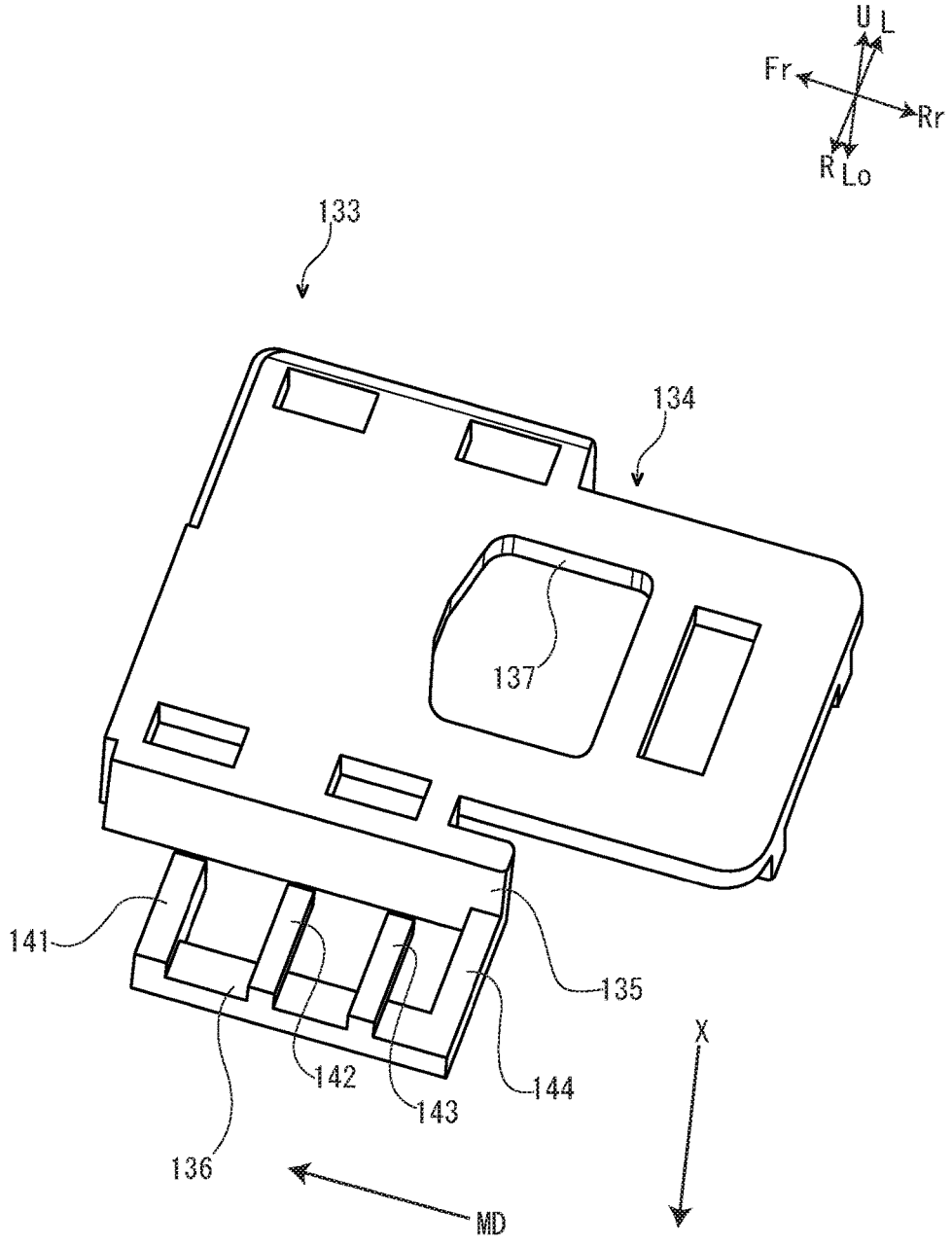
FIG. 8 is a perspective view showing the replenishment shutter, in the multifunctional peripheral according to the embodiment of the present disclosure.

With reference to FIG. 6, the attachment part 16 includes four replenishment shutters 133 (one of them is only shown in FIG. 6) at the lower side of the attachment positions of the toner containers 15. With reference to FIG. 8, each replenishment shutter 133 includes a main wall 134, a bent wall 135 bent downward from a right end of the main wall 134 and a support wall 136 provided on the right side of the bent wall 135.

The main wall 134 of each replenishment shutter 133 is formed in a flat plate-like shape. Each replenishment shutter 133 is configured to be linearly movable along the front-and-rear direction between a second closing position (refer to FIG. 4) where the main wall 134 closes the corresponding replenishment port 132 of the casing 128 and a second opening position (refer to FIG. 5) where the main wall 134 opens the corresponding replenishment port 132 of the casing 128. Hereinafter, a linear moving direction of each replenishment shutter 133 from the second closing position to the second opening position is called as a moving direction MD (refer to FIG. 8).

The main wall 134 of each replenishment shutter 133 has a through port 137. The through port 137 is not communicated with the corresponding replenishment port 132 of the casing 128 in a state where each replenishment shutter 133 is moved to the second closing position, and is communicated with the corresponding replenishment port 132 of the casing 128 in a state where each replenishment shutter 133 is moved to the second opening position.

With reference to FIG. 8, the support wall 136 of each replenishment shutter 133 is arranged at a downstream side of the main wall 134 of each replenishment shutter 133 in the attachment direction X. A rear end portion (an upstream side end portion in the moving direction MD) of the support wall 136 is connected to the bent wall 135 of each replenishment shutter 133 via a connecting wall 144 extending along the left-and-right direction.

On an upper face of the support wall 136 of each replenishment shutter 133, a first pressed part 141, a second pressed part 142 provided at the upstream side of the first pressed part 141 in the moving direction MD and a third pressed part 143 provided at the upstream side of the second pressed part 142 in the moving direction MD are provided. The first to third pressed parts 141 to 143 are aligned along the moving direction MD along which each replenishment shutter 133 is linearly moved. The first to third pressed parts 141 to 143 are provided at equal intervals, and extend along the left-and-right direction. Right end portions (one end portions in a longitudinal direction) of the first to third pressed parts 141 to 143 are connected to the support wall 136. Left end portions (other end portions in the longitudinal direction) of the first to third pressed parts 141 to 143 are free, and face an outer face of the bent wall 135 via gaps. Thereby, the first to third pressed parts 141 to 143 are elastically deformable around the right end portions.

In the multifunctional peripheral 1 having the above described configuration, an operation to replenish the developing device 8 of each image forming part 6 with the toner from the toner container 15 will be described on an assumption that the toner container 15 is attached to the attachment part 16.

When the developing device 8 of the image forming part 6 is replenished with the toner from the toner container 15, in a state (refer to FIG. 3) where the transmitting coupling 90 of the toner container 15 is coupled to the driving coupling 123 and the discharge port 45 of the toner container 15 is opened, the driving source 124 is operated. When the driving source 124 is operated, the driving coupling 123 is rotated by driving force from the driving source 124. When the driving coupling 123 is rotated, rotation of the driving coupling 123 is transmitted to the agitating shaft 52 of the agitator 22 (refer to FIG. 2) by the transmitter 30 and the connecting gear (not shown) to rotate the agitator 22. Consequently, the toner stored in the storage 36 of the case main body 21 is agitated by the agitator 22.

Additionally, when the driving coupling 123 is rotated as described above, the rotation is transmitted to the conveyer 23 by the transmitter 30 to rotate the conveyer 23. Consequently, as shown by an arrow B in FIG. 3, the toner stored in the storage 36 and the duct 38 of the case main body 21 is conveyed by the conveyer 23 toward the discharge port 45. The toner conveyed toward the discharge port 45 is, as shown by an arrow C in FIG. 3, discharged outside the toner container 15 through the discharge port 45.

The toner discharged outside the toner container 15 through the discharge port 45 is introduced in the replenishment duct 130 of the casing 128 through the replenishment port 132. The toner introduced in the replenishment duct 130 is conveyed in the replenishment duct 130 by the replenishment screw 131 and replenished to the developing device 8 of the image forming part 6 from the replenishment duct 130.

Next, in the multifunctional peripheral 1 having the above described configuration, an operation to open and close the replenishment port 132 with opening and closing of the discharge port 45 will be described on an assumption that the toner container 15 is attached to the attachment part 16.

When the discharge shutter 26 is moved to the first closing position and the replenishment shutter 133 is moved to the second closing position, as shown in FIG. 4, the main body part 65 of the discharge shutter 26 closes the discharge port 45 and the main wall 134 of the replenishment shutter 133 closes the replenishment port 132. This prevents the toner from being leaked through the discharge port 45 and the replenishment port 132.

In a state where the discharge shutter 26 is moved to the first closing position and the replenishment shutter 133 is moved to the second closing position, when a worker, such as a user and a serviceman, rotates the lever 24 in one direction, rotation of the lever 24 is transmitted to the discharge shutter 26 via the connecting mechanism 120 to rotate the discharge shutter 26 from the first closing position to the first opening position. Thereby, as shown in FIG. 5, the main body part 65 of the discharge shutter 26 opens the discharge port 45.

Figure 9A:
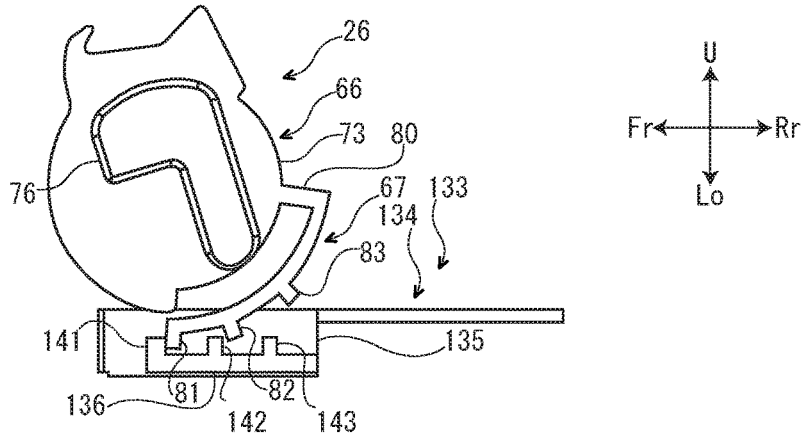
FIG. 9A is a side view showing a state where a first pressing part of the discharge shutter presses a first pressed part of the replenishment shutter, in the multifunctional peripheral according to the embodiment of the present disclosure.
Figure 9B:
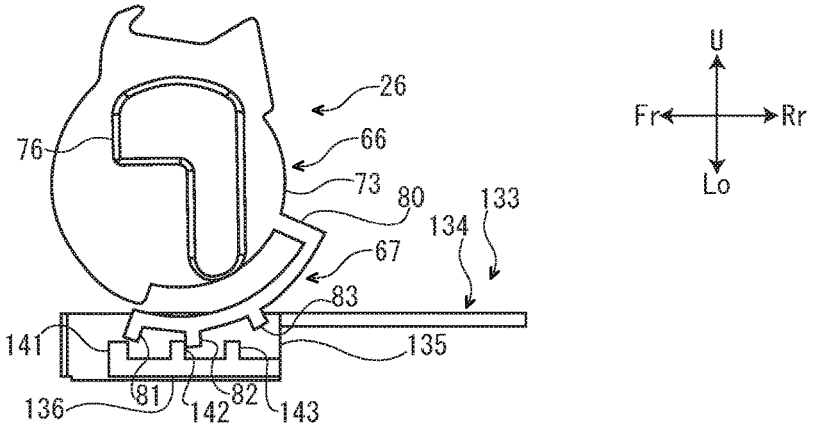
FIG. 9B is a side view showing a state where a second pressing part of the discharge shutter presses a second pressed part of the replenishment shutter, in the multifunctional peripheral according to the embodiment of the present disclosure.
Figure 9C:
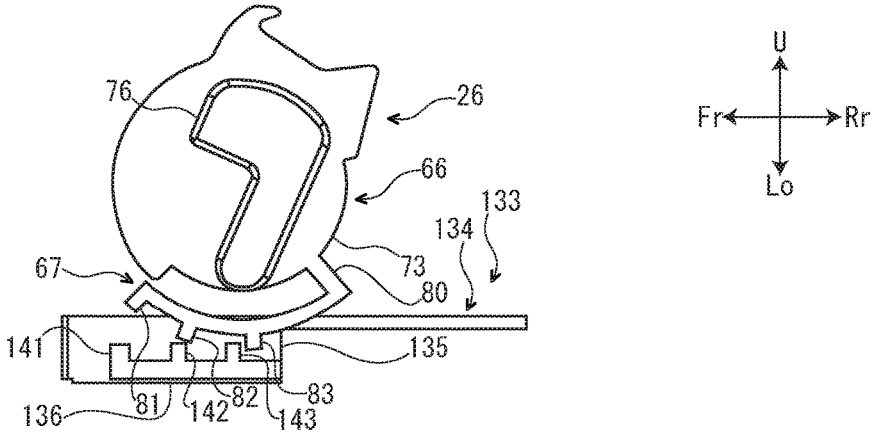
FIG. 9C is a side view showing a state where the discharge shutter is moved to the first opening position and the replenishment shutter is moved to the second opening position, in the multifunctional peripheral according to the embodiment of the present disclosure.

Additionally, as the discharge shutter 26 is rotated from the first closing position to the first opening position, as shown in FIG. 9A, the first pressing part 81 of the discharge shutter 26 presses the first pressed part 141 of the replenishment shutter 133 to the front side to move the replenishment shutter 133 to the front side. Next, as shown in FIG. 9B, the second pressing part 82 of the discharge shutter 26 presses the second pressed part 142 of the replenishment shutter 133 to the front side to move the replenishment shutter 133 to the front side further. In this way, as shown in FIG. 9C, the replenishment shutter 133 is moved from the second closing position to the second opening position. Thereby, as shown in FIG. 5, the main wall 134 of the replenishment shutter 133 opens the replenishment port 132.

On the other hand, in a state where the discharge shutter 26 is moved to the first opening position and the replenishment shutter 133 is moved to the second opening position, when the worker rotates the lever 24 in an opposite direction to the above one direction, the rotation of the lever 24 is transmitted to the discharge shutter 26 via the connecting mechanism 120 to rotate the discharge shutter 26 from the first opening position to the first closing position. Thereby, as shown in FIG. 4, the main body part 65 of the discharge shutter 26 closes the discharge port 45.

Figure 10A:
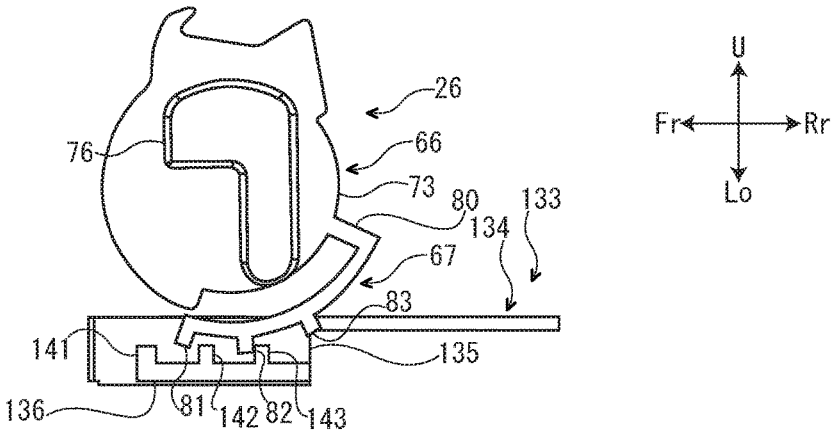
FIG. 10A is a side view showing a state where the second pressing part of the discharge shutter presses a third pressed part of the replenishment shutter, in the multifunctional peripheral according to the embodiment of the present disclosure.
Figure 10B:
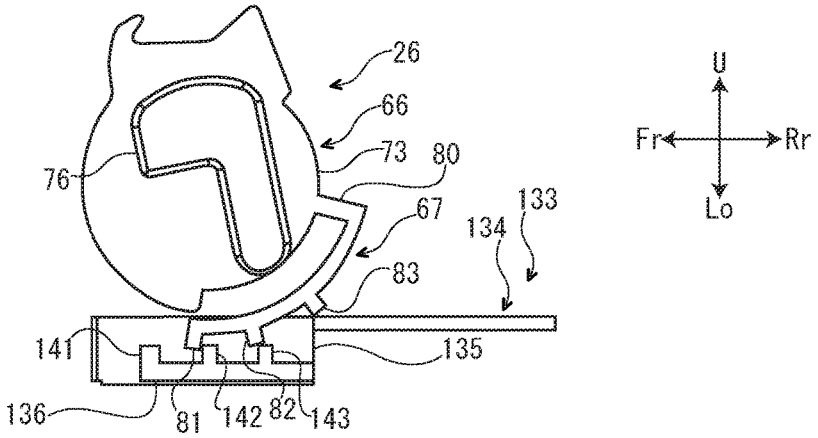
FIG. 10B is a side view showing a state where the first pressing part of the discharge shutter presses the second pressed part of the replenishment shutter, in the multifunctional peripheral according to the embodiment of the present disclosure.
Figure 10C:
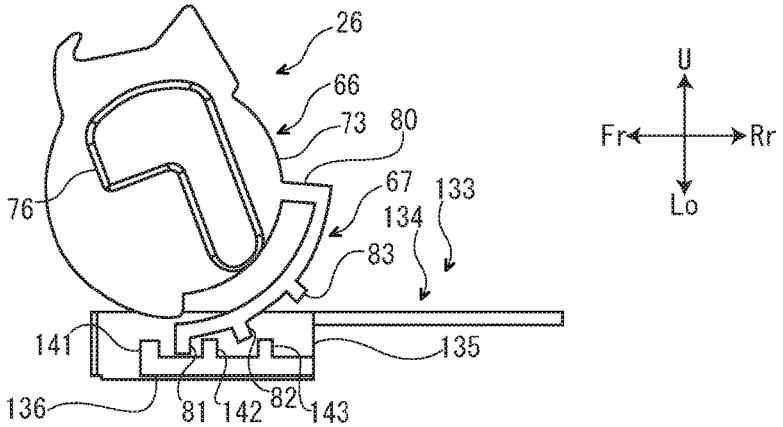
FIG. 10C is a side view showing a state where the discharge shutter is moved to the first closing position and the replenishment shutter is moved to the second closing position, in the multifunctional peripheral according to the embodiment of the present disclosure.

Additionally, as the discharge shutter 26 is rotated from the first opening position to the first closing position as described above, as shown in FIG. 10A, the second pressing part 82 of the discharge shutter 26 presses the third pressed part 143 of the replenishment shutter 133 to the rear side to move the replenishment shutter 133 to the rear side. Next, as shown in FIG. 10B, the first pressing part 81 of the discharge shutter 26 presses the second pressed part 142 of the replenishment shutter 133 to the rear side to move the replenishment shutter 133 to the rear side further. In this way, as shown in FIG. 10C, the replenishment shutter 133 moves from the second opening position to the second closing position. Thereby, as shown in FIG. 4, the main wall 134 of the replenishment shutter 133 closes the replenishment port 132.

In the present embodiment, as described above, as the discharge shutter 26 rotates from the first closing position to the first opening position, the discharge shutter 26 presses the replenishment shutter 133 to move the replenishment shutter 133 from the second closing position to the second opening position, and as the discharge shutter 26 rotates from the first opening position to the first closing position, the discharge shutter 26 presses the replenishment shutter 133 to move the replenishment shutter 133 from the second opening position to the second closing position. By applying such a configuration, as compared with a case where the replenishment shutter 133 is moved by using only biasing force of a biasing member, such as a coil spring, it becomes possible to reduce impact occurred when the replenishment shutter 133 opens and closes the replenishment port 132 (especially, impact occurred when the replenishment shutter 133 closes the replenishment port 132). Therefore, it becomes possible to inhibit the toner around the replenishment port 132 from being scattered and the toner container 15 and the attachment part 16 from being contaminated with the scattered toner.

Additionally, as the discharge shutter 26 is rotated from the first closing position to the first opening position, the first pressing part 81 presses the first pressed part 141 and the second pressing part 82 presses the second pressed part 142. By applying such a configuration, it becomes possible to move the replenishment shutter 133 from the second closing position to the second opening position smoothly.

Additionally, as the discharge shutter 26 is rotated from the first opening position to the first closing position, the second pressing part 82 presses the third pressed part 143 and the first pressing part 81 presses the second pressed part 142. By applying such a configuration, it becomes possible to move the replenishment shutter 133 from the second opening position to the second closing position smoothly.

Additionally, the first and second pressing parts 81 and 82 are arranged along the rotating direction RD of the discharge shutter 26, and the first and second pressed parts 141 and 142 are arranged along the linear moving direction MD of the replenishment shutter 133. By applying such a configuration, the first and second pressing parts 81 and 82 are capable of pressing the first and second pressed parts 141 and 142 surely.

Additionally, the one end portion in the longitudinal direction of the arm part 67 is connected to the outer circumferential face of the closing part 66, another end portion in the longitudinal direction of the arm part 67 is free, and the first and second pressing parts 81 and 82 are protruded on the outer circumferential face of the arm part 67. By applying such a configuration, it becomes possible to suppress the attachment of the toner container 15 to the attachment part 16 from being inhibited by interference between the first and second pressing parts 81 and 82 and the first and second pressed parts 141 and 142 so that it becomes possible to attach the toner container 15 to the attachment part 16 surely.

Additionally, the one end portions in the longitudinal directions of the first and second pressed parts 141 and 142 are connected to the support wall 136, and other end portions in the longitudinal directions of the first and second pressed parts 141 and 142 are free. By applying such a configuration, it becomes possible to suppress the attachment of the toner container 15 to the attachment part 16 from being inhibited by interference between the first and second pressing parts 81 and 82 and the first and second pressed parts 141 and 142 more effectively so that it becomes possible to attach the toner container 15 to the attachment part 16 more surely.

Additionally, when the lever 24 is rotated in a state where the toner container 15 is attached to the attachment part 16, the rotation of the lever 24 is transmitted to the discharge shutter 26 via the connecting mechanism 120 to rotate the discharge shutter 26. By applying such a configuration, when the worker rotates the lever 24, it becomes possible to perform opening and closing of the discharge port 45 at the same time of opening and closing of the replenishment port 132. This makes possible to reduce work load of the worker.

Figure 11:
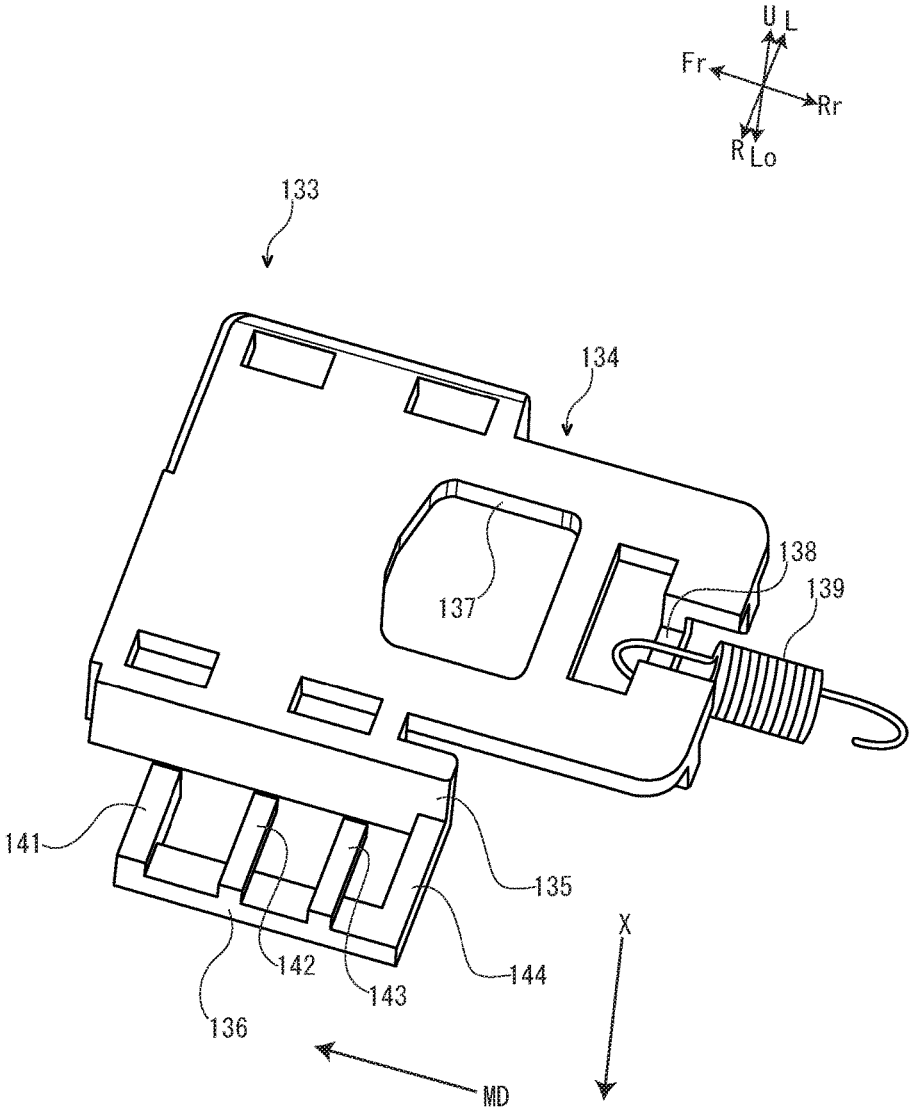
FIG. 11 is a perspective view showing the replenishment shutter and a coil spring, in the attachment part according to another embodiment of the present disclosure.

Although it is not described in the present embodiment in detail, in another embodiment, as shown in FIG. 11, the main wall 134 of the replenishment shutter 133 may include a mounting part 138, and a coil spring 139 (an example of a biasing member) mounted to the mounting part 138 may bias the replenishment shutter 133 to the second closing position. By applying such a configuration, it becomes possible to inhibit the replenishment shutter 133 from being moved from the second closing position to the second opening position accidentally.

In the present embodiment, the arm part 67 of the discharge shutter 26 is arranged along the outer circumferential face of the closing part 66. On the other hand, in still another embodiment, the arm part 67 of the discharge shutter 26 may be arranged along an outer circumferential face of the main body part 65.

In the present embodiment, the discharge shutter 26 is rotated between the first closing position and the first opening position. On the other hand, in still another embodiment, the discharge shutter 26 may be linearly moved between the first closing position and the first opening position.

In the present embodiment, the replenishment shutter 133 is linearly moved between the second closing position and the second opening position. On the other hand, in still another embodiment, the replenishment shutter 133 may be rotated between the second closing position and the second opening position.

In the present embodiment, the discharge shutter 26 includes a plurality of pressing parts and the replenishment shutter 133 includes a plurality of pressed parts. On the other hand, a number of either of the pressing parts and the pressed parts may be one.

In the present embodiment, an entire part of the conveyer 23 is stored in the case main body 21. On the other hand, in still another embodiment, a part of the conveyer 23 may be stored in the case main body 21.

In the present embodiment, a part of the transmitter 30 is exposed to the outside of the case main body 21. On the other hand, in still another embodiment, an entire part of the transmitter 30 may be exposed to the outside of the case main body 21.

In the present embodiment, the main body part 65 of the discharge shutter 26 is rotatably attached to the inner circumference of the duct 38 of the case main body 21. On the other hand, instill another embodiment, the discharge shutter 26 may be rotatably attached to an outer circumference of the duct 38.

In the present embodiment, the conveyer 23 is an example of the rotator. On the other hand, in still another embodiment, the agitator 22 or the others may be an example of the rotator.

In the present embodiment, the discharge port 45 of each toner container 15 is connected to the developing device 8 of each image forming part 6 via the replenishment duct 130. On the other hand, in still another embodiment, the discharge port 45 of each toner container 15 may be directly connected to the developing device 8 of each image forming part 6.

In the present embodiment, the lever 24 of each toner container 15 is connected to the discharge shutter 26 via the connecting mechanism 120 of the attachment part 16. On the other hand, in still another embodiment, the lever 24 of each toner container 15 may be directly connected to the discharge shutter 26.

In the present embodiment, the configuration of the present disclosure is applied to the multifunctional peripheral 1. On the other hand, in still another embodiment, the configuration of the present disclosure may be applied to an image forming apparatus, such as a printer, a copying machine and a facsimile, other than the multifunctional peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a toner case; and an attachment part to which the toner case is detachably attached, wherein the toner case includes:

a case main body having a discharge port through which a toner is discharged; and a discharge shutter movable between a first closing position where the discharge shutter closes the discharge port and a first opening position where the discharge shutter opens the discharge port, the attachment part includes:

a housing having a replenishment port through which the toner discharged through the discharge port is introduced; and a replenishment shutter movable between a second closing position where the replenishment shutter closes the replenishment port and a second opening position where the replenishment shutter opens the replenishment port, wherein as the discharge shutter moves from the first closing position to the first opening position, the discharge shutter presses the replenishment shutter to move the replenishment shutter from the second closing position to the second opening position, and as the discharge shutter moves from the first opening position to the first closing position, the discharge shutter presses the replenishment shutter to move the replenishment shutter from the second opening position to the second closing position, wherein the discharge shutter includes:

a first pressing part; and a second pressing part provided at an upstream side of the first pressing part in a moving direction of the discharge shutter from the first closing position to the first opening position, the replenishment shutter includes:

a first pressed part; and a second pressed part provided at an upstream side of the first pressed part in a moving direction of the replenishment shutter from the second closing position to the second opening position, wherein as the discharge shutter moves from the first closing position to the first opening position, the first pressing part presses the first pressed part and the second pressing part presses the second pressed part, wherein the toner case further includes a rotator rotating around a rotation axis, at least a part of the rotator being stored in the case main body, the discharge shutter includes:

a main body part formed in a cylindrical shape extending along a rotation axis direction of the rotator, and opening and closing the discharge port;

a closing part which closes an end of the main body part at an outside in the rotation axis direction; and an arm part arranged along an outer circumferential face of the main body part or the closing part, wherein one end of the arm part in a longitudinal direction is connected to the outer circumferential face of the main body part or the closing part, another end of the arm part in the longitudinal direction is free, and the first and second pressing parts are protruded on an outer circumferential face of the arm part.

2. The image forming apparatus according to claim 1, wherein the replenishment shutter further includes a third pressed part provided at an upstream side of the second pressed part in the moving direction of the replenishment shutter from the second closing position to the second opening position, as the discharge shutter moves from the first opening position to the first closing position, the second pressing part presses the third pressed part and the first pressing part presses the second pressed part.

3. The image forming apparatus according to claim 1, wherein the discharge shutter is rotatable, the first and second pressing parts are arranged along a rotating direction of the discharge shutter, the replenishment shutter is linearly movable, and the first and second pressed parts are arranged along a linear moving direction of the replenishment shutter.

4. The image forming apparatus according to claim 1, wherein the case main body includes a duct formed in a cylindrical shape extending along the rotation axis direction, and the main body part is rotatably attached to an inner circumference of the duct.

5. The image forming apparatus according to claim 1, wherein one end of the rotator in the rotation axis direction is rotatably inserted into the closing part.

6. The image forming apparatus according to claim 1, wherein the discharge shutter is rotatable, and the arm part is curved in an arc shape along a rotating direction of the discharge shutter.

7. The image forming apparatus according to claim 1, wherein the replenishment shutter includes:

a main wall which opens and closes the replenishment port; and a support wall arranged at a downstream side of the main wall in an attaching direction of the toner case to the attachment part, wherein one ends of the first and second pressed parts in longitudinal directions are connected to the support wall, and other ends of the first and second pressed parts in the longitudinal directions are free.

8. An image forming apparatus comprising:

a toner case; and an attachment part to which the toner case is detachably attached, wherein the toner case includes:

a case main body having a discharge port through which a toner is discharged; and a discharge shutter movable between a first closing position where the discharge shutter closes the discharge port and a first opening position where the discharge shutter opens the discharge port, the attachment part includes:

a housing having a replenishment port through which the toner discharged through the discharge port is introduced; and a replenishment shutter movable between a second closing position where the replenishment shutter closes the replenishment port and a second opening position where the replenishment shutter opens the replenishment port, wherein as the discharge shutter moves from the first closing position to the first opening position, the discharge shutter presses the replenishment shutter to move the replenishment shutter from the second closing position to the second opening position, and as the discharge shutter moves from the first opening position to the first closing position, the discharge shutter presses the replenishment shutter to move the replenishment shutter from the second opening position to the second closing position, wherein the attachment part further includes a biasing member which biases the replenishment shutter to the second closing position.

9. An image forming apparatus comprising:

a toner case; and an attachment part to which the toner case is detachably attached, wherein the toner case includes:

a case main body having a discharge port through which a toner is discharged; and a discharge shutter movable between a first closing position where the discharge shutter closes the discharge port and a first opening position where the discharge shutter opens the discharge port, the attachment part includes:

a housing having a replenishment port through which the toner discharged through the discharge port is introduced; and a replenishment shutter movable between a second closing position where the replenishment shutter closes the replenishment port and a second opening position where the replenishment shutter opens the replenishment port, wherein as the discharge shutter moves from the first closing position to the first opening position, the discharge shutter presses the replenishment shutter to move the replenishment shutter from the second closing position to the second opening position, and as the discharge shutter moves from the first opening position to the first closing position, the discharge shutter presses the replenishment shutter to move the replenishment shutter from the second opening position to the second closing position, wherein the toner case further includes a manipulation member rotatably supported by the case main body, the discharge shutter is rotatable, and the attachment part further includes a connecting mechanism which connects the manipulation member to the discharge shutter, wherein when the manipulation member is rotated in a state where the toner case is attached to the attachment part, rotation of the manipulation member is transmitted to the discharge shutter via the connecting mechanism to rotate the discharge shutter.

* * * * *